United States Patent [19]

Schaeffer

[11] 4,292,782

[45] Oct. 6, 1981

[54] SHEET METAL STRUCTURAL BEAM

[75] Inventor: Jack A. Schaeffer, Reading, Pa.

[73] Assignee: Dana Corporation, Toledo, Ohio

[21] Appl. No.: 58,681

[22] Filed: Jul. 18, 1979

[51] Int. Cl.[3] ..... E04C 3/02

[52] U.S. Cl. ..... 52/696; 52/730

[58] Field of Search ..... 52/730, 731, 696, 729, 52/694, 732

[56] References Cited

U.S. PATENT DOCUMENTS

| | | | |
|---|---|---|---|
| 1,649,577 | 11/1927 | Coryell | 52/696 X |
| 2,125,691 | 8/1938 | Ragsdale et al. | 52/731 |
| 3,362,056 | 1/1968 | Preller et al. | 52/729 X |
| 3,381,439 | 5/1968 | Thulin, Jr. | 52/729 |
| 3,444,664 | 5/1969 | Fink, Jr. et al. | 52/732 |
| 3,626,653 | 12/1971 | Amirikian | 52/731 X |

FOREIGN PATENT DOCUMENTS

| | | | |
|---|---|---|---|
| 1353612 | 1/1964 | France | 52/729 |
| 414118 | 12/1966 | Switzerland | 52/729 |

*Primary Examiner*—Carl D. Friedman

*Attorney, Agent, or Firm*—Emch, Schaffer, Schaub & Todd

[57] ABSTRACT

A structural element having two opposed and parallel U-shaped members opening toward one another with a web of elongated corrugated form extending between the first and second U-shaped members. The web has a first set of coplanar flats fixed to opposed coplanar first sides of the two U-shaped members and a second set of coplanar flats fixed to opposed coplanar second sides of the two U-shaped members. The first coplanar flats alternate with and are joined to the second coplanar flats by secondary flats which have stepped relief cut-outs and are spaced apart from the U-shaped members.

3 Claims, 5 Drawing Figures

SHEET METAL STRUCTURAL BEAM

BACKGROUND OF THE INVENTION

This invention is directed toward a structural element for use, for example, as a siderail in a tractor trailer.

Siderails used in vehicles often have a C-shaped or a modified C-shaped cross section. Although siderails of of this type may be formed to meet design bending forces, they generally have inadequate resistance to torsional forces. If a predetermined resistance to torsional forces is required, it often has been necessary to over design the structural element in its resistance to simple bending forces.

One design for structural beams is to provide two opposed and parallel flat plates of elongated shape with a corrugated web fixed between the two flat plates by continuous welds or solder strips, as illustrated in U.S. Pat. No. 3,362,056. The welding or soldering operation is time-consuming and expensive and, therefore, is an area of design improvement. Moreover, it is desirable to reduce the amount of weld or solder in each element, thereby effecting a desirable loss in weight for each element. A basic objective, then, is to produce a structural beam with a minimum amount of weld or solder while achieving the optimal stuctural strength.

SUMMARY OF THE INVENTION

The present invention is directed to an improved structural element or side rail suitable for use in vehicles, for example. The structural element is composed of two elongated U-shaped members with a corrugated web fixed between them. The two U-shaped members each have first and second opposed planar sides and a flat planar base. The two U-shaped members open toward one another with their first sides complanar and their second sides coplanar. The web, which is, continually formed from a single element, extends between the U-shaped members. The web is of a corrugated elongated form and has a first set of coplanar flats interconnected with a second set of coplanar flats by secondary flats. The flats of the first set are welded to the first sides of the U-shaped members and the flats of the second set are welded to the second sides of the U-shaped members. Preferably, the web does not contact the flat planar base of either U-shaped member. The secondary flats of the web have stepped relief cutouts so as to be spaced from both U-shaped members.

The structural element or siderail of the invention has torsion properties four times that of the standard "C" channel. The web member includes stepped relief cutouts which lighten the total weight. If further weight reduction is desired, small holes may be cut in the flats which constitute the web member without a noticeable loss in the superior torsion properties. The lack of a continuous weld or solder line serves to further lighten the siderail while the placement of the welds location on the exterior of the siderail eases the time and effort in construction, thereby reducing costs.

Accordingly, it is an objective of this invention to provide a lightweight structural element of superior bending and torsional properties.

Another object of the invention is to provide an elongated structural element at less cost and having a lower weight than prior art structural elements having similar bending and torsional properties.

The various objects and features of the invention will be more fully understood from the following description of the preferred embodiment with reference to the accompanying drawings in which.

DETAILED DESCRIPTION OF THE INVENTION

Figures 1, 2, 3, 4, 5:
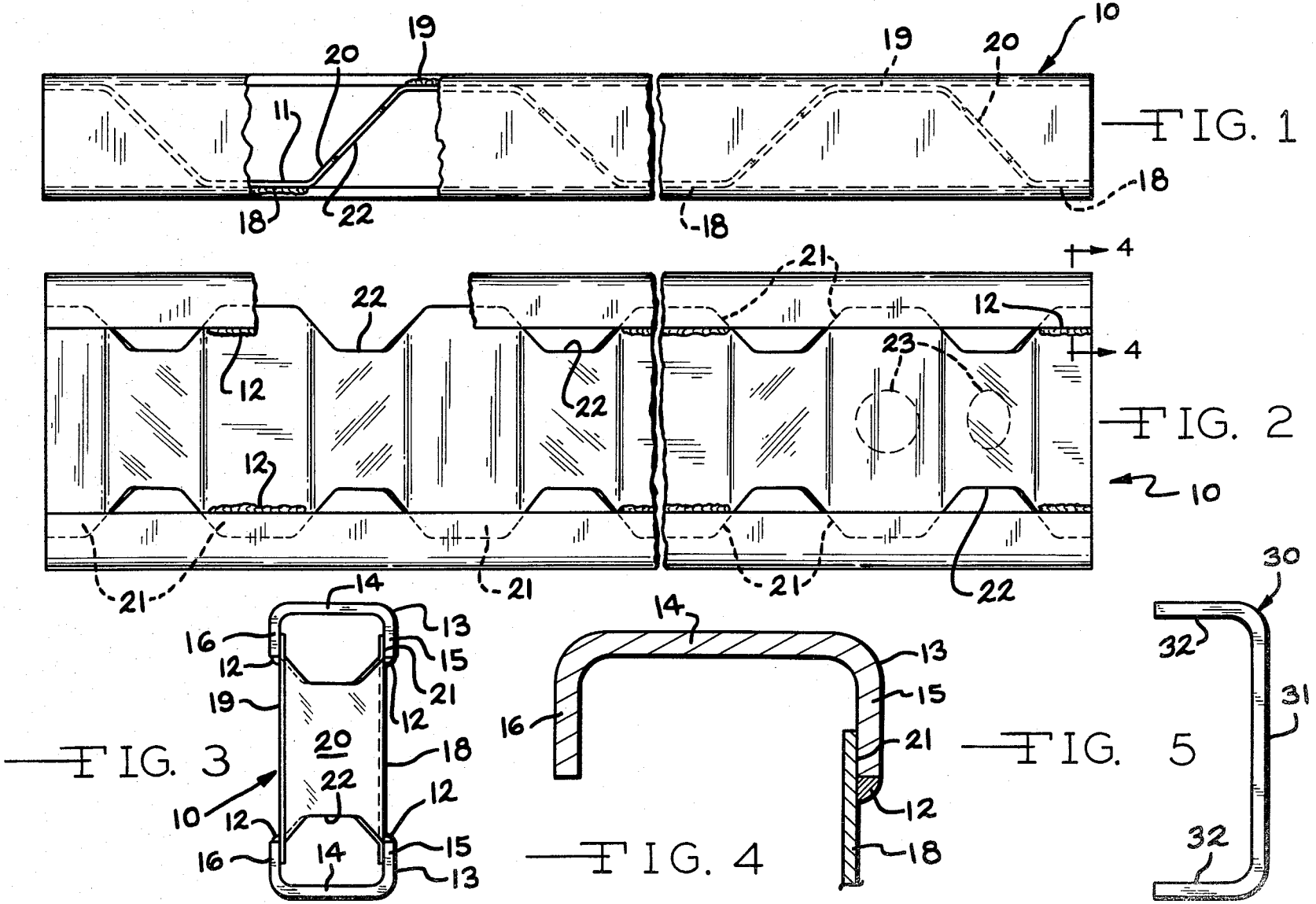
FIG. 1 is a top view of the structural element of the present invention with a partial cut-away view of a traversing or secondary flat.
FIG. 2 is a side view of the present invention with a portion of the top "C" channel cut-away.
FIG. 3 is an end view of the present invention.
FIG. 4 is a fragmentary view taken along line 4—4 of FIG. 2.
FIG. 5 is a transverse cross sectional view through a conventional prior art C-shaped structural element.

Referring now to FIGS. 1–4, a structural element or siderail 10 is shown as comprising a corrugated web 11 fixed by welds 12 to two spaced U-shaped members 13. Each U-shaped member 13 has a flat planar base 14, intergrally connected to first and second opposed, parallel planar sides 15 and 16 respectively. The members 13 may be of standard channel stock, for example. The two U-shaped members 13 are positioned to open toward one another with their first sides 15 coplanar and their second sides 16 coplanar. The web 11 is of continual elongate corrugated form and extends between the the U-shaped members 13. The web 11 is formed from a single element and has a first set of spaced coplanar flats 18 and a second set of spaced coplanar flats 19 alternately spaced with the first flat 18. The flats 18 and 19 are spaced apart to fit between and abut the sides 15 and 16 of each U-shaped member 13. The first flats 18 are joined with the second coplanar flats 19 by a series of traversing or secondary flats 20.

The web 11 is fixed to the first coplanar sides 15 and the second coplanar sides 16 of the two U-shaped members 13, but preferably, does not contact the flat planar base 14 of either U-shaped member 13. The first flats 18 are welded or otherwise fixed to the first sides 15 of both of the U-shaped members 13, creating a slight overlap 21 which provides structural strength. Similary, the second flats 19 are welded or otherwise fixed to the second sides 16 of both of the U-shaped members 13, again creating a slight overlap 21 which provides structural strength.

The secondary flats 20, in a preferred embodiment of the structural element 10, have stepped relief cutouts 22 which provide the desired weight reduction. If further weight reduction is desired, small holes 23 can be formed in the differing flats 18, 19 and 20 of the corrugated web member 11. Further weight reduction is achieved by spacing the secondary flats 20 from the U-shaped members 13. This eliminates the weight of welding as well as reducing the time in manufacturing each siderail 10.

FIG. 5 illustrates a prior art beam or structural element 30 having a C-shaped cross section. Structural elements of this type are commonly used as siderails in vehicles. The element 30 generally comprises a large vertical web 31 connected to a flat horizontal upper flange 32 and to a flat horizonal lower flange 33. Specimens of the structural elements 10 and 30 were constructed to have the same height, width and weight per unit length. These specimens were then subjected successively to vertical bending, lateral bending and torsional forces and the relative stiffness of the specimens was measured. In a vertical direction, the structural element 10 had a stiffness of 92% of that of the structural element 30. In a lateral direction, the structural element 10 had a stiffness of 111% of the structural element 30. For torsional bending, the structural element 10 had a stiffness of 407% of the structural element 30. Therefore, when a structural element is subjected to lateral and torsional forces in addition to vertical forces, a structural element having the configuration of the element 10 is superior to a conventional C-shaped element 30. This is particularly true when a high torsional stiffness is desired.

It will be appreciated that variations and other embodiments of the structural element 10 are possible and that changes can be made without departing from the scope of the following claims.

I claim:

1. A structural element comprising: a first U-shaped elongate member having a first flat planar base with first and second spaced parallel planar sides extending integrally from said first base; a second U-shaped elongate member having a second flat planar base with first and second spaced parallel planar sides extending integrally from said second base, said first and said second U-shaped elongate members opening toward one another with said first sides coplanar and with said second sides coplanar; an elongate corrugated web extending between said first and second U-shaped members, said web having a plurality of spaced first coplanar flats and a plurality of second coplanar flats disposed parallel to and alternately spaced with said first coplanar flats, said first sides overlapping a portion of each of said first flats and said second sides overlapping a portion of each of second flats; means permanently connecting said first flats to said first sides; and means permanently connecting said second flats to said second sides, and wherein said web has edges spaced from both said first base of said first U-shaped member and said second base of said second U-shaped member.

2. A structural element, as defined in claim 1, wherein said first flats are joined with said second flats by a plurality of integrally formed secondary flats and wherein said secondary flats have edges spaced from said first and second bases further than the edges of said first and second sides are spaced from said first and second bases.

3. A structural element comprising a first U-shaped elongate member having a first flat planar base with first and second spaced parallel planar sides extending integrally from said first base, a second U-shaped elongate member having a second flat planar base with first and second spaced parallel planar sides extending integrally from said second base, said first and said second U-shaped elongated members opening toward one another with said first sides coplanar and with said said second sides coplanar, a continual elongate corrugated web extending between said first and second U-shaped members, said web having edges spaced from both of said first and second bases, said web having a plurality of first coplanar flats overlapping and welded to said first sides and a plurality of second coplanar flats alternately spaced with said first flats overlapping and welded to said second sides, said web further having a plurality of secondary flats integrally joining said first and second flats, said secondary flats having a greater spacing from said first and second bases than said first and second flats.

* * * * *